US011358212B2

(12) United States Patent
Hilger et al.

(10) Patent No.: US 11,358,212 B2
(45) Date of Patent: Jun. 14, 2022

(54) RISER SLEEVE, METHOD FOR PRODUCING A RISER BODY FOR THE RISER SLEEVE AS WELL AS AN EXPANDER ELEMENT AND CORE BOX FOR PRODUCING A RISER BODY

(71) Applicant: GTP Schäfer Gießtechnische Produkte GmbH, Grevenbroich (DE)

(72) Inventors: Olof Hilger, Wuppertal (DE); Jörg Schäfer, Frechen (DE); Thomas Schäfer, Frechen (DE)

(73) Assignee: GTP Schäfer Gießtechnische Produkte GmbH, Grevenbroich (DE)

( * ) Notice: Subject to any disclaimer, the term of this patent is extended or adjusted under 35 U.S.C. 154(b) by 0 days.

(21) Appl. No.: 16/788,946

(22) Filed: Feb. 12, 2020

(65) Prior Publication Data

US 2020/0254510 A1 Aug. 13, 2020

(30) Foreign Application Priority Data

Feb. 13, 2019 (EP) ..... 19156932

(51) Int. Cl.
*B22C 9/08* (2006.01)
*B22C 7/06* (2006.01)

(52) U.S. Cl.
CPC ..... *B22C 9/082* (2013.01); *B22C 7/06* (2013.01); *B22C 9/088* (2013.01)

(58) Field of Classification Search
CPC .... B22C 7/00; B22C 7/06; B22C 9/08; B22C 9/082; B22C 9/088
USPC ..... 164/15, 244, 359, 360
See application file for complete search history.

(56) References Cited

FOREIGN PATENT DOCUMENTS

| | | | | |
|---|---|---|---|---|
| CN | 206869021 U | * | 1/2018 | ..... B22C 9/08 |
| DE | 1256360 B | | 12/1967 | |
| DE | 8702296 U1 | | 4/1987 | |
| EP | 3003601 B1 | | 4/2016 | |
| WO | 2016050264 A1 | | 4/2016 | |
| WO | 2017046007 A1 | | 3/2017 | |

OTHER PUBLICATIONS

Machine translation of CN 206869021 U (Year: 2018).*

* cited by examiner

*Primary Examiner* — Kevin P Kerns
(74) *Attorney, Agent, or Firm* — Calfee, Halter & Griswold LLP

(57) ABSTRACT

A riser sleeve (1) for using when pouring metals into a casting mould includes a riser body (2). The riser body (2) includes a riser cavity (3) for holding liquid metal and a riser opening (4) for joining the riser cavity (3) to a mould cavity of the casting mould during the casting process.

Figure 1:
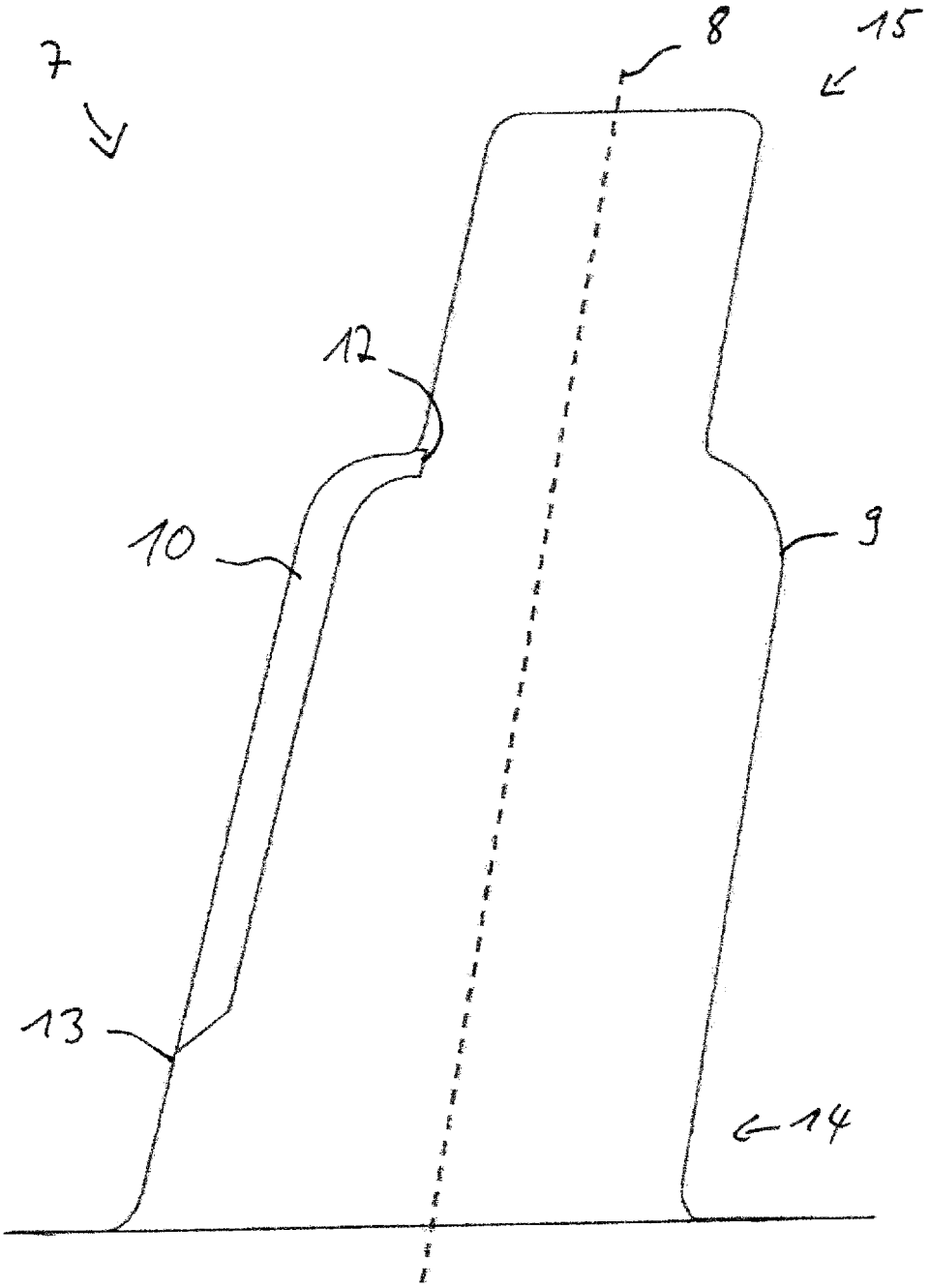

The riser cavity (3) has a greater diameter than the diameter of the riser opening (4) in at least one portion, the riser body (2) is made of an insulating and/or exothermic riser material.

The riser body (2) is formed as a single piece,
the riser opening (4) defines an axis (5), and
the riser cavity (3) is asymmetric to the axis (5).

8 Claims, 4 Drawing Sheets

RISER SLEEVE, METHOD FOR PRODUCING A RISER BODY FOR THE RISER SLEEVE AS WELL AS AN EXPANDER ELEMENT AND CORE BOX FOR PRODUCING A RISER BODY

RELATED APPLICATION

This application claims priority to European Patent EP 19156932.6 filed with the European Patent Office on Feb. 13, 2019. The preceding application is herein incorporated by reference in its entirety.

DESCRIPTION

The present invention relates to a riser sleeve comprising a riser body for use when pouring metals into a casting mould, a method for producing a single-piece riser body, as well as an expander element and a core box comprising the expander element for producing a single-piece riser body.

In foundry technology, it is often necessary to arrange additional riser sleeves in the casting moulds, the riser body of which fills with the liquid metal when moulding the casting and compensates for the volume deficits occurring during the solidification of the casting in order to prevent the formation of shrink holes in the casting. For this purpose, the riser sleeves are provided in such a way that the liquid metal fed within is later solidified as the casting so that a transport of metal towards the casting can take place during the solidification process, thereby filling the casting in a manner that is free of shrink holes. For this purpose, the riser sleeves consist of an exothermic and/or insulating material. For this purpose, the riser sleeves have a riser cavity for holding liquid metal as well as a riser opening for joining the riser cavity to a mould cavity of the casting mould during the casting process. In a plurality of applications, the riser sleeve is vertically aligned during the casting process, i.e. an axis defined by the riser opening is vertically aligned. In this case, the riser cavity adjoining the riser opening is usually designed to be rotationally symmetric around the axis, wherein the hydrostatic pressure of the liquid metal located in the riser cavity is sufficient for feeding.

However, there are areas of application where the riser sleeve is horizontally aligned during the casting process with its axis defined by the riser opening. For example, vertical green-sand moulding systems for the production of casting moulds (also known as DISA moulding plants and DISA-MATIC®) are known, in which a first model half is mounted on an exclusively linearly adjustable press piston and a second model half is mounted on a pivoting moulding plate, which is movable back and forth between a placement position in which, for example, this is horizontally or vertically aligned and in which it is equipped with a riser sleeve, and one, in particular, vertically aligned casting position. With these vertically divided casting moulds, with which relatively thin-walled castings can be produced and in which the riser sleeve is horizontally aligned during the casting process, the problem is in ensuring that feeding takes place. Thus, for example, from EP 3 003 601 B1, a two-part riser body is known, whose riser cavity limited by two moulding elements with a horizontal arrangement of the axis has a predominant fraction of its volume above the axis so that the hydrostatic pressure of the liquid metal above the axis is sufficient for feeding. The two moulding elements of this riser sleeve can be moved to each other in a telescopic manner so that, during the production of the casting moulding, the one moulding element is moved towards the other moulding element, whereby a compaction of the moulding material of the mould in the region surrounding the riser opening is made possible.

From DE 87 02 296, a riser sleeve is known, which is made of two moulding elements due to the undercut design of the riser cavity to the riser opening, which two mounding elements have to be glued together after their respective production, which increases the producing effort of the riser sleeve. It is therefore desirable to simplify the riser body of a riser sleeve and its production.

For a riser sleeve that is vertically aligned during the casting process, which has a rotationally symmetrical riser cavity, it is known from WO 2017/046007 A1 to produce a single-piece riser body by means of a core shooter where an expandable rotationally symmetrical expander element specifies the geometrical shape of the riser cavity during the shooting operation.

The object of the present invention is therefore to eliminate the disadvantages described with reference to prior art and, in particular, to indicate a riser sleeve, a method for producing a single-piece riser body, as well as an expander element and a core box comprising an expander element, by means of which the production of a riser sleeve arranged horizontally during the casting process is simplified.

The problem is solved by means of a riser sleeve, a method for producing a riser body, as well as by an expander element and a core box of a core shooter with the features of the respective independent claim. Favourable further embodiments of the invention are indicated in the dependent claims and in the description, wherein individual features of the favourable embodiments can be combined with one another in a sensible manner.

The task is solved, in particular, by means of an expander element for producing a riser body, the outer contour of which is expandable and which extends along a central longitudinal axis in an unexpanded state, wherein the expander element has an asymmetrical shape in an expanded state with reference to the longitudinal axis.

In the unexpanded state, in particular, the expander element has a cross-sectional design, which can be conically tapered from a base, which can also be called a foot, of the expander element towards a free end. The cross-sectional design in the unexpanded state of the expander element can be, for example, circular, oval, elliptical, trapezoidal, rectangular or square, wherein, in the case of a rectangular or square cross-sectional design, the corners can be rounded off. In the case of a rectangular or square cross-sectional design, the expander element has two side walls, the cross sections of which are each at least parallel.

According to the invention, it is now provided that the expander element in an expanded state has an asymmetrical shape in relation to the longitudinal axis. The outer contour of the expanded expander element thus extends in one direction with a greater distance from the longitudinal axis defined in the unexpanded state than in an opposite direction (in a cross-sectional plane orthogonal to the longitudinal axis). The expander element is, in particular, designed in such a way that an elongation in the region of the base of the expander element does not take place or only takes place a little so that the base of the expander element specifies the shape of the riser opening of the riser body to be produced.

Such an expander element together with a core shooter is, in particular, used in a core shooter for producing a riser body, wherein the core box comprises at least one first box and one second box. The core box can also comprise further boxes.

Such a core box with a corresponding expander element can be used for producing a single-piece riser body of a riser sleeve, wherein the production method comprises at least the following steps (also in any order provided it is technical reasonable):

- forming at least one first partial cavity in a first box and a second partial cavity in a second box,
- bringing together of at least the first box and of the second box so that the first partial cavity and the second partial cavity form a cavity with an inner wall, wherein the inner wall at least partially forms the outer contour of the riser body,
- setting a reversibly expandable expander element into the cavity,
- expanding the expander element so that the expanded expander element has an asymmetrical outer shape at least in sections, in particular, with reference to a longitudinal axis defined in the original state,
- introduction of exothermic and/or insulated riser material between the expanded expander element and the inner wall of the cavity for forming the riser body, wherein the expander element specifies a shape of a riser cavity,
- constriction of the expander element, preferably after the riser material has been hardened,
- removal of the expander element from the riser body by relatively moving between the expander element and the riser body, wherein the constricted expander element is moved out through the riser opening, which is formed during the introduction process within the region of the unexpanded base of the expander element.

Such an asymmetric outer shape of the expanded expander element can be achieved, for example, by means of the expansion of the expander element taking place during production in one direction and not expanding in the opposing direction. Of course, however, a greater expansion in one direction and a lesser expansion in an opposite direction can also take place.

Such an expansion in one direction can be achieved, for example, by the fact that the expander element has a fixed mandrel and comprises a flexible membrane attached to the mandrel, which can be expanded by means of introducing a fluid into an intermediate space between the membrane and the mandrel, wherein the membrane expands orthogonally to the longitudinal axis of the mandrel when expanding on a plane. For example, this can occur by means of the fact that the membrane comprises elasticity modules arranged in an unequally distributed manner on a local level. Alternatively, the expanding in one direction could be due to a boundary element, which is applied onto the flexible membrane from the outside.

It is however preferred that an extension in one direction and no extension into the opposite direction is achieved by means of the membrane is attached with its peripheral edges, for example, by means of vulcanization, to the mandrel both in the axial direction (meaning below in the region of the base and above in the region of the free end of the expander element) as well as in the circumferential direction (meaning, for example, along the longitudinal axis on the surface of the fixed mandrel).

A riser body produced in this way comprises a riser cavity for holding liquid metal and a riser opening for connecting the riser cavity to a mould cavity of the casting mould during the casting process, wherein the riser cavity has a greater diameter than the diameter of the riser opening in at least one portion, wherein the riser opening defines an axis. The riser body is made of an insulating and/or exothermic riser material and is formed as a single piece, wherein the riser cavity is asymmetrical with respect to the axis. Such a riser sleeve can be produced in just one single shooting operation in a core shooter.

Thereby, the riser cavity has a volume, which is designed in such a way that, in the case of a horizontal arrangement of the riser sleeve and the axis defined by the riser opening, a greater volume fraction of the volume of the riser cavity can be positioned above the axis than under the axis. Such a riser sleeve is ideally suited for a vertically divided casting mould, where the riser sleeve is horizontally arranged during the casting process since the liquid metal located above the axis during the casting process provides a sufficient hydrostatic pressure, which is sufficient for a feeding of liquid metal into the mould cavity of the casting mould.

The exothermic and/or insulating material of the riser body is uniformly and homogeneously distributed in the wall region, the lid region and the base region of the riser body comprising the riser opening thereby being so that no boundaries between individual sections of the riser body would be formed, as would be the case, for example, if the riser body were glued together from a plurality of parts. The riser body can, in particular, comprise another (ventilation) opening on a side opposite to the riser opening (meaning in the lid region), which is used for guiding the cap during moulding. For example, such another opening can be created during the producing process of the riser body, while the free end of the expander element opposite to the base of the expander element is not expandable or can relatively be expanded only a little. The asymmetry of the riser cavity is characterized in that, in particular, the riser cavity extends orthogonally to this axis from the axis defined by the riser opening than in an opposite direction. Thus, the riser cavity may be aligned during the casting process in such a way that a larger riser volume is arranged above the axis than below.

Preferably, the riser cavity on its peripheral surface in the area of the asymmetric embodiment has a minimal place, which has a smaller distance to the axis than adjacent points on the peripheral surface, which are arranged adjacent in the axial direction and opposite to the minimum position. Such a minimal place, with which the liquid material first comes into contact when filling the riser cavity, improves the feeding. For example, such a punctiform or (in particular, orientated in the circumferential direction) linear minimal place (also known as a Williams groove or a Williams element) can, during the production of the riser body be produced by the expanded expander element having a corresponding minimal place on its expanded surface, which comprises a smaller distance to the longitudinal axis (of the unexpanded expander element) than axially adjacent points on the expanded surface in both directions.

In order to form the minimal place on the expanded surface of the expander element, the membrane can be connected to the mandrel on its inner side in an expandable region in such a way that the expansion of the membrane is locally limited. For example, the membrane can be directly attached to the mandrel at a punctiform or linear point so that, at this attachment point, no expansion of the membrane takes place. Alternatively, the expansion of the membrane can also be limited using an arrestor strap, which is attached with an end on the mandrel and with another end on the inner side of the membrane.

In a preferred embodiment, in the unexpanded state, the expander element has a rectangular cross-sectional shape, in particular, a square one with parallel side walls, wherein the side wall can be attached to one another due to roundings. The side walls can additionally be formed along the longitudinal axis in a conically tapered manner. Thereby, the produced riser opening of the riser body would also have an essentially rectangular (cross-sectional) shape. In this connection, in particular, it is provided that the membrane is only arranged on one side wall of the expander element. As an alternative, the expander element can have a cross-sectional shape, such as round, oval or elliptical, wherein the membrane preferably only extends in the circumferential direction across one part of the circumference. For example, the membrane extends in the circumferential direction across no more than half of the total circumference.

After the riser body is produced, in particular, the accessories can, in particular, be attached to the riser body for forming a riser neck and thereby for forming a predetermined breaking point of the metallic rest of the riser near the casting part surface for example, a so-called ME sheet in the region of the riser opening on the outside of the riser body. As an alternative, it would also be possible that the accessories are arranged in the core boxes in order to already be connected to the riser body produced in the process already during the shooting process. In particular, the riser sleeve then comprises the riser body and the accessories.

The invention as well as the technical field are explained based on the figures as an example. Schematically, the figures show FIG. 1 a lateral view of an expander element in an initial state, FIG. 2 the expander element in an expanded state, FIG. 3 an expanded expander element with a riser body and FIG. 4 the riser body as an inherent component of a riser sleeve.

FIG. 1 shows an expander element in an unexpanded state. The expander element 7 comprises a mandrel 9 and a membrane 10. The expander element 7 extends along a longitudinal axis 8 from a base 14 to a free end 15.

The cross-sectional shape of the unexpanded expander element 7 is rectangular, wherein the membrane 10 only extends across a side wall 13 of the mandrel 9. The membrane 10 is completely attached to the mandrel with its peripheral edge 12. Due to lines in the inside of the mandrel 9 (not shown), it is possible to convey a fluid into an intermediate space 11 between the mandrel 9 and the membrane 10 so that the membrane 10 and, thereby, the outer contour of the expander element 7 are expanded.

Figure 2:
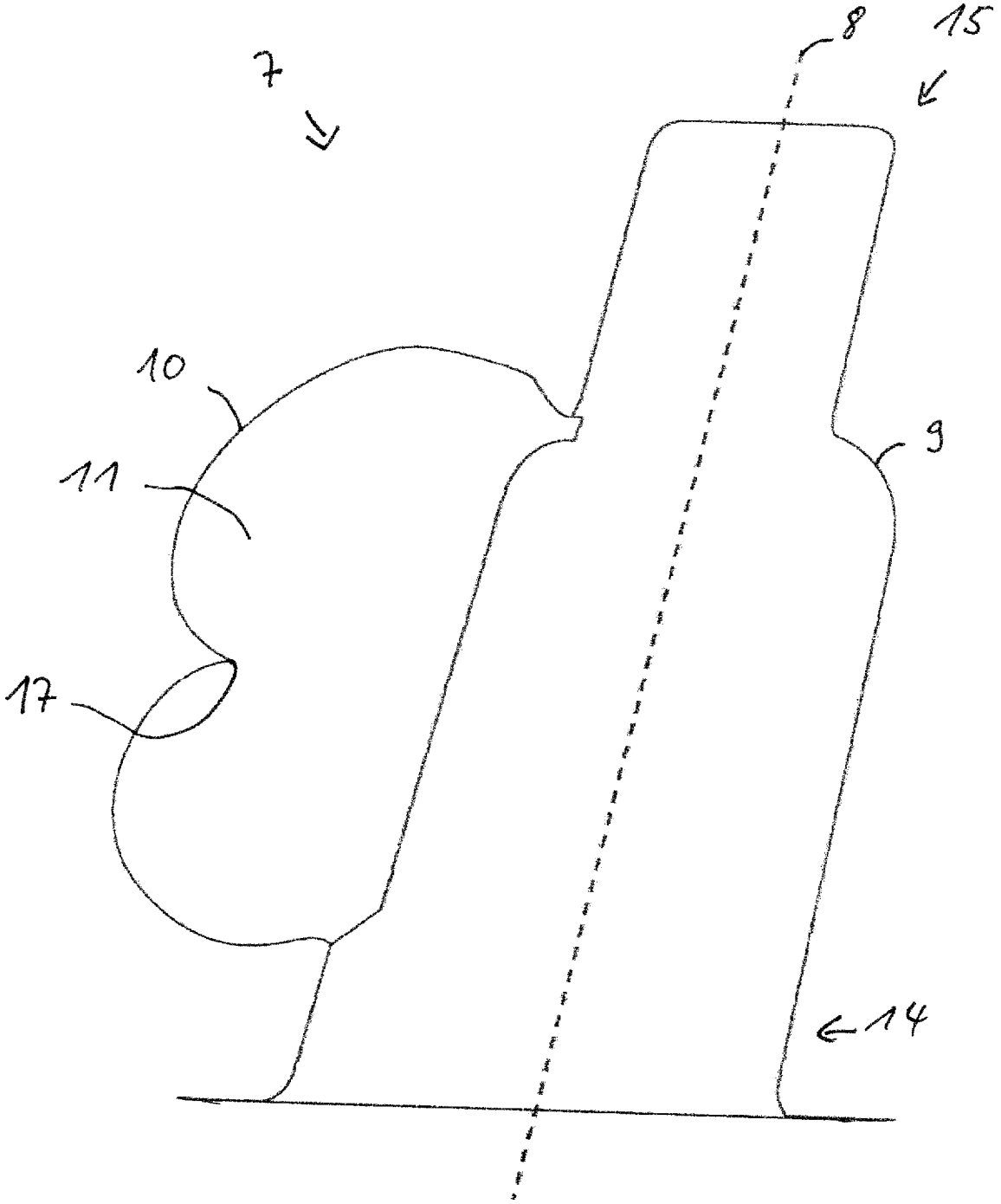

The accordingly expanded expander element is shown in FIG. 2. It is clear that the membrane 10 has only expanded into the direction shown left in FIG. 2 and not into the opposite right direction. In accordance with this, the expander element 7 has an asymmetrical shape with reference to the longitudinal axis 8. By connecting the membrane 10 to a surface of the mandrel 9, it is also possible that, on the external contour of the expanded region, a minimal place 17 forms so that the expanded area has a camel-hump-like structure.

Figure 3:
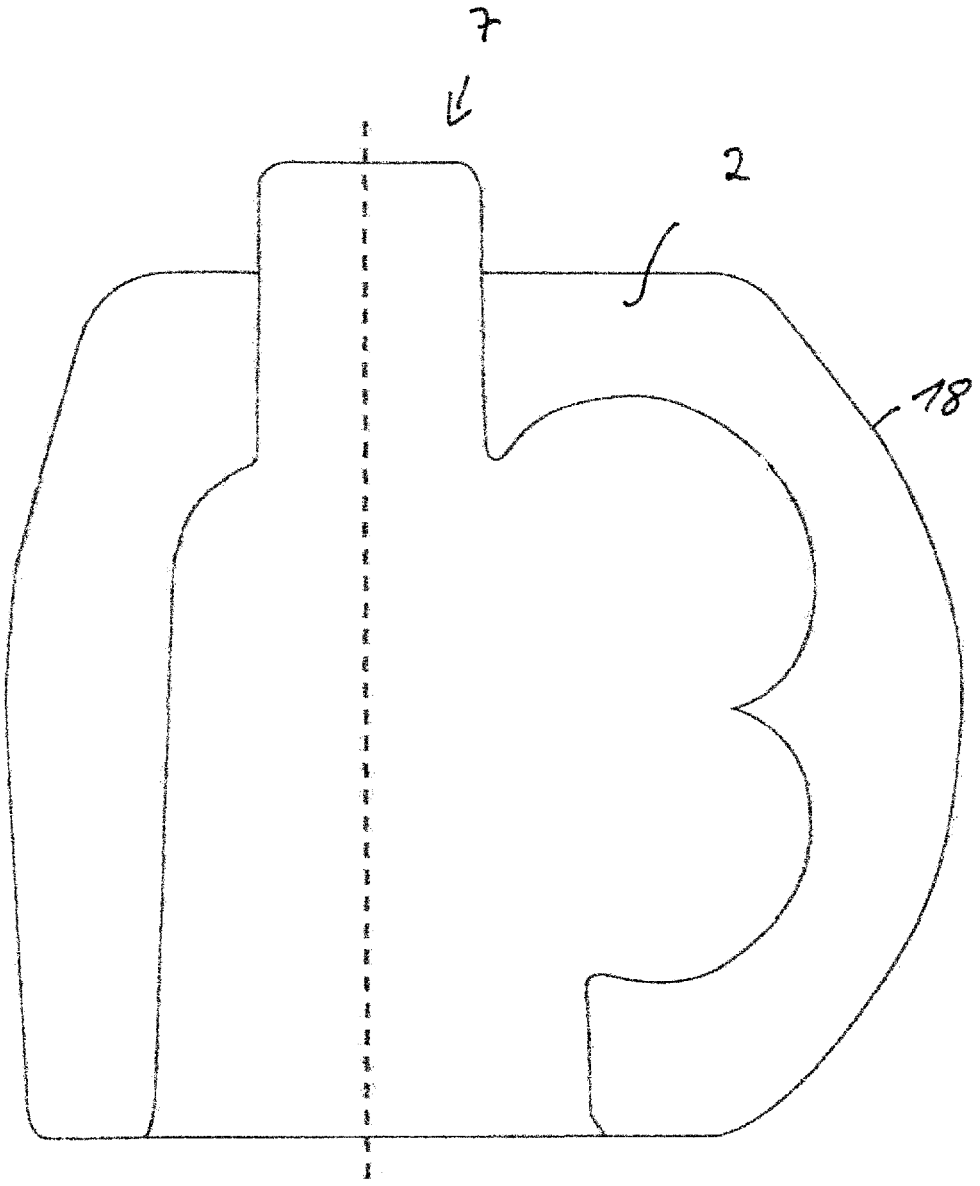

Such an expander element 7 is used in a core shooter for producing a riser body 2. FIG. 3 shows the use of a similar expander element 7 with core boxes (not shown) of a core shooter. The core boxes each have a partial cavity, which, in a merged state, form a cavity with an inner wall 18, wherein this inner wall 18 specifies the outer contour of the riser body 2 to be produced. In order to produce the riser body 2, an exothermic and/or insulating riser material is shot between the inner wall 18 of the cavity formed by the core boxes and the outer contour of the expanded expander element 7. In FIG. 3, a correspondingly expanded expander element 7 with a shot-in riser body 2 is shown, wherein the core boxes, which specify the outer contour of the riser body 2 are not shown.

Figure 4:
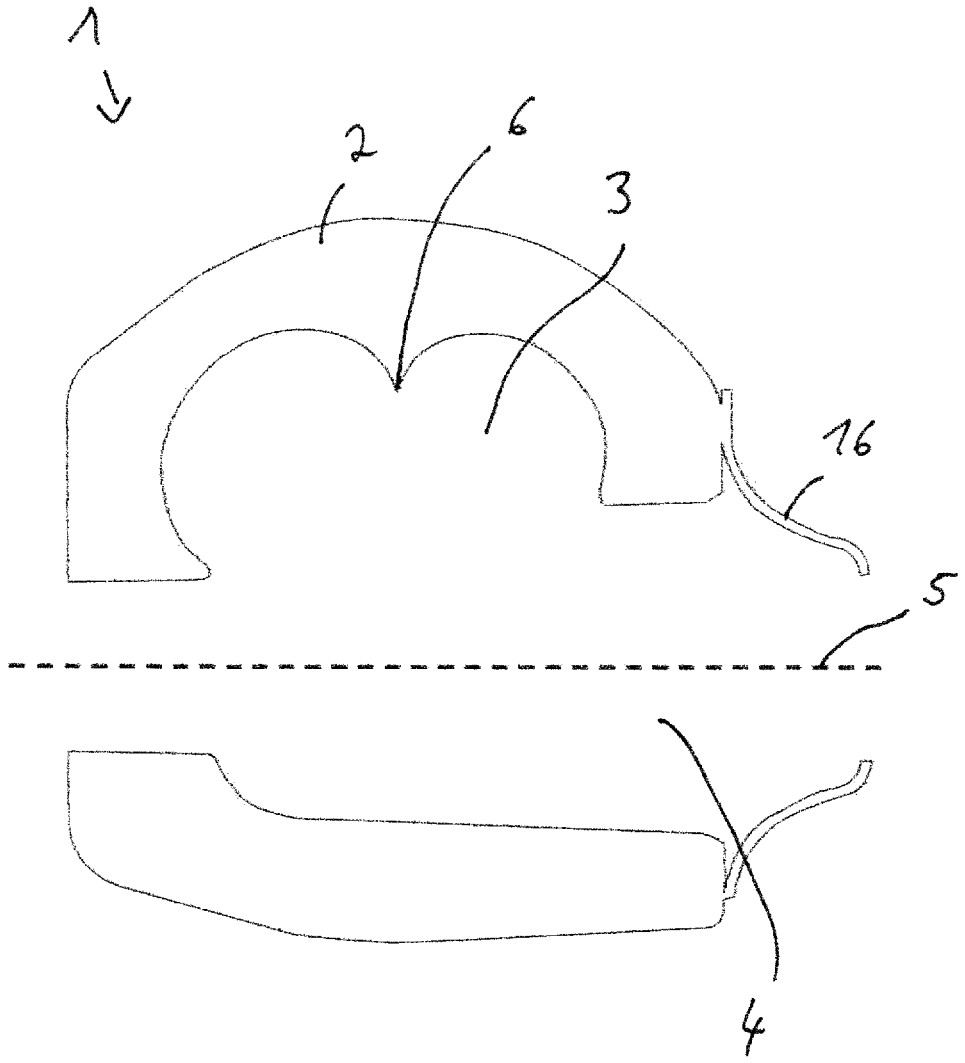

In FIG. 4, a riser sleeve 1 is shown, which comprises the riser body 2 and an ME sheet 16. The riser body 2 comprises a riser cavity 3 and a riser opening 4, by which the riser cavity 3 is connected to a mould cavity (not shown) of a casting mould during the casting process. The riser opening 4 defines an axis 5, wherein it is clearly visible that the diameter of the riser cavity 3 is greater than the diameter of the riser opening 4. Such riser sleeve 1 is used in the case of vertically divided casting moulds in particular where the riser sleeve 1 is horizontally aligned with its axis during the casting process. During the casting process, the riser sleeve 1 lies in a resting position.

Since the volume of the riser cavity 3 is greater above the axis 5 than below the axis 5, during the casting process, a sufficiently high hydrostatic pressure is available due to the liquid metal in order to ensure feeding. The Williams element 6 formed on the peripheral surface of the riser cavity 3 serves as a hotspot for the liquid metal.

With the present invention, an asymmetrical riser body comprising a riser cavity can be produced as a single piece in just one production process so that the effort for producing such a riser body is considerably simplified.

REFERENCE LIST

1 riser sleeve
2 riser body
3 riser cavity
4 riser opening
5 axis
6 Williams element
7 expander element
8 longitudinal axis
9 mandrel
10 membrane
11 intermediate space
12 peripheral edge
13 side wall
14 base
15 free end
16 sheet
17 minimal place
18 inner wall

The invention claimed is:

1. Method for producing a single-piece riser body (2) of a riser sleeve (1), comprising the following steps:

forming at least one first partial cavity in a first box and a second partial cavity in a second box, bringing together at least the first box and the second box so that the at least one first partial cavity and the second partial cavity form a cavity with an inner wall (18), wherein the inner wall (18) at least partially forms an outer contour of the riser body (2) to be produced, setting an expander element (7) into the cavity, wherein the expander element (7) is configured for producing the riser body (2) in a core box, wherein the expander element (7) comprises a fixed mandrel (9) and a flexible membrane (10) that is attached to the mandrel (9), wherein an outer contour of the expander element (7) is reversibly expandable between an unexpanded state and an expanded state and wherein the outer contour of the expander element (7) extends along a central longitudinal axis (8) in the unexpanded state, wherein the flexible membrane is expanded by introducing a fluid into an intermediate space (11) between the membrane (10) and the mandrel (9), and further wherein the expander element (7) is characterized in that the expander element (7), in the expanded state of the expander element (7), has an asymmetrical outer shape with reference to the longitudinal axis (8);

expanding the expander element (7) so that the expanded expander element (7) has the asymmetrical outer shape, introducing an exothermic and/or insulating riser material between the expanded expander element (7) and the inner wall (18) of the cavity for formation of the riser body (2), wherein the expanded expander element (7) specifies a shape of a riser cavity (3), constricting of the expander element (7), removing the expander element (7) out of the riser body (2) by means of a relative movement between the expander element (7) and the riser body (2), wherein the constricted expander element (7) is moved out through a riser opening (4) formed during the introducing step.

2. Method according to claim 1, wherein the expanding of the expander element (7) takes place in one direction and no expanding takes place in an opposing direction.

3. Expander element (7) that is configured for production of a riser body (2) in a core box, wherein the expander element (7) comprises a fixed mandrel (9) and a flexible membrane (10) that is attached to the mandrel (9), wherein an outer contour of the expander element (7) is reversibly expandable between an unexpanded state and an expanded state and wherein the outer contour of the expander element (7) extends along a central longitudinal axis (8) in the unexpanded state, wherein the flexible membrane is expanded by introducing a fluid into an intermediate space (11) between the membrane (10) and the mandrel (9), and further wherein the expander element (7) is characterized in that the expander element (7), in the expanded state of the expander element (7), has an asymmetrical outer shape with reference to the longitudinal axis (8).

4. Expander element (7) according to claim 3, wherein the asymmetrical expanded expander element (7) has a minimal point (17) on an expanded surface, which comprises a smaller distance to the longitudinal axis (8) than points that are axially adjacent in both directions on the expanded surface.

5. Expander element (7) according to claim 3, wherein the expander element (7) has a rectangular-shaped cross-section with parallel side walls (13) in the unexpanded state.

6. Expander element (7) according to claim 3, wherein the membrane (10) is attached with its peripheral edges (12) to the mandrel (9) both in the axial direction as well as in a circumferential direction.

7. Expander element (7) according to claim 3, wherein the membrane (10) on its inner side in an expanded region is connected to the mandrel (9) in such a way that expansion of the membrane (10) is limited locally.

8. Expander element (7) according to claim 3, wherein the membrane (10) is arranged only on a side wall (13) of the expander element (7).

* * * * *